US006564896B1

(12) United States Patent
Proksch et al.

(10) Patent No.: US 6,564,896 B1
(45) Date of Patent: May 20, 2003

(54) TILTABLE CONTROL CONSOLE FOR A BACKHOE LOADER MACHINE

(75) Inventors: Fred D. Proksch, deceased, late of Peoria, IL (US), by Patricia A. Proksch, legal representative; Hugh Rillie, Raleigh, NC (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/593,894

(22) Filed: Jun. 14, 2000

Related U.S. Application Data

(60) Provisional application No. 60/140,419, filed on Jun. 22, 1999.

(51) Int. Cl.[7] ..... B62D 1/14

(52) U.S. Cl. ..... 180/326; 180/334; 180/333; 74/493

(58) Field of Search ..... 180/326, 334, 180/272, 324, 331–333; 74/493; 280/775

(56) References Cited

U.S. PATENT DOCUMENTS

| | | | | | |
|---|---|---|---|---|---|
| 3,887,095 | A | * | 6/1975 | Suzuki | 214/130 R |
| 4,140,200 | A | * | 2/1979 | Tucek | 180/77 H |
| 4,158,968 | A | * | 6/1979 | Wilson et al. | 74/471 R |
| 4,278,144 | A | | 7/1981 | Perin | 180/329 |
| 4,821,837 | A | * | 4/1989 | Fifer | 180/334 |
| 4,869,337 | A | | 9/1989 | Wagner | 180/330 |
| 5,002,332 | A | | 3/1991 | Ikeda | 296/190 |
| 5,050,700 | A | * | 9/1991 | Kim | 180/268 |
| 5,110,253 | A | | 5/1992 | Ernst et al. | 414/694 |
| 5,138,756 | A | | 8/1992 | Johnson et al. | 29/401.1 |
| 5,346,035 | A | * | 9/1994 | Ueda et al. | 180/329 |
| 5,409,080 | A | * | 4/1995 | Templeton et al. | 180/326 |
| 5,566,778 | A | * | 10/1996 | Valier et al. | 180/334 |
| 5,664,909 | A | * | 9/1997 | Lindgren et al. | 404/122 |
| 5,732,788 | A | * | 3/1998 | Brown | 180/326 |
| 5,890,562 | A | * | 4/1999 | Bartels et al. | 187/224 |
| 5,921,340 | A | * | 7/1999 | Abels | 180/326 |
| 5,924,515 | A | * | 7/1999 | Stauffer | 180/326 |
| 5,964,313 | A | * | 10/1999 | Guy | 180/332 |
| 6,148,688 | A | * | 11/2000 | Nishimaki | 74/493 |
| 6,148,946 | A | * | 11/2000 | Takahasi et al. | 180/316 |

FOREIGN PATENT DOCUMENTS

GB 2 224 559 A 9/1990

* cited by examiner

*Primary Examiner*—Lesley D. Morris
*Assistant Examiner*—L. Lum
(74) *Attorney, Agent, or Firm*—Diana L Charlton

(57) ABSTRACT

The present invention includes a tiltable control console positioned within a rear interior portion of a cab of a work machine, such as a backhoe loader. The work machine includes a seat rotatable between front and rear positions. The control console includes a tower assembly that enables tiltable movement of the control consoles between stowed and operating positions and a controller connected with the tower assembly. When the seat is in the front position, an operator may operate specific functions for a loader bucket of the work machine. When the operator is ready to operate specific functions for a backhoe bucket of the work machine, the operator may rotate the seat from the front position to the rear position. However, the seat may remain in the front position to operate the specific function for the backhoe bucket. At that time, the operator may move the control console from the stowed position to the operating position through the movement of the tower assembly.

13 Claims, 10 Drawing Sheets

TILTABLE CONTROL CONSOLE FOR A BACKHOE LOADER MACHINE

This application claims the benefit of prior provisional patent application Ser. No. 60/140,419 filed Jun. 22, 1999.

TECHNICAL FIELD

This invention relates generally to a tiltable control console for a backhoe loader machine. More particularly, the invention relates to the ability of the control console to be maintained in a stowed position when an operator is not operating the backhoe functions of the machine and the ability to move the control console to an operating position when the operator desires operating the backhoe functions of the machine, the control console being moved in a manner that positions it ergonomically for the operator's utilization.

BACKGROUND ART

It is well-known in the prior art to utilize a control console for a backhoe loader machine for operating specific backhoe functions. Typically, the control console is fixably mounted in a rear interior portion of a cab. In order for an operator to control the specific backhoe functions, the operator must rotate a seat mounted within the cab from a front position for operating specific loader functions to a rear position. Once the seat is in the rear position, it must be subsequently moved toward the rear of the machine to position the operator near the control console. Generally, the control console is positioned between the legs of the operator during control of the specific backhoe functions. Additionally, operator input to the control console mechanically controls the specific backhoe functions.

In the well-known design, the fixed mounting of the control console in the rear interior portion of the cab increases the spatial requirements of the cab. The increased spatial requirements are necessary because the operator must be able to rotate the seat from the front position to the rear position. The rotation of the seat requires a certain amount of space between the control console and the legs of the operator. Unfortunately, the space significantly distances the operator from the control console. Therefore, the seat is moved toward the rear of the machine to position the operator near the control console thus requiring additional floor space. Further, the position of the control console between the legs of the operator reduces visibility at the rear of the machine and forces the operator to control the specific backhoe functions of the machine at a location that may not be ergonomically sound. The ability of an operator to ergonomically control the specific backhoe functions of the machine results in less operator fatigue and inefficiency. Therefore, it is important to ergonomically position the control console for maximum operator ease and control. Additionally, the mechanical control of the specific backhoe functions of the machine through the control console may provide lower control sensitivity. Therefore, precise control of the specific backhoe functions of the machine may be limited.

The present invention is directed to overcoming the problems as set forth above.

DISCLOSURE OF THE INVENTION

In one aspect of the present invention, a tiltable control console is used on a backhoe loader machine. The backhoe loader machine has a frame with front and rear interior portions and a seat positioned on the frame. The seat is rotatably mounted thereto for movement between front and rear positions and has a centerline. The tiltable control console comprises a tower assembly positionable within the rear interior portion of the frame and tiltably mountable therewith for movement between stowed and operating positions. A controller is connected with the tower assembly for operating specific functions of the backhoe loader machine. The controller is utilized to operate the backhoe loader machine when the tower assembly is in one of the operating and stowed positions and the seat is located in any position between the front and rear positions.

The present invention includes a tiltable control console positioned within a rear interior portion of a backhoe loader machine. The backhoe loader machine includes a seat mounted therein rotatable between front and rear positions. The control console includes a tower assembly that enables tiltable movement between stowed and operating positions and a controller connected with the tower assembly. The controller is utilized by an operator to operate the backhoe loader machine when the tower assembly is in either the operating or the stowed positions and the seat is in either of the front or rear positions or any position therebetween. However, the ability to stow the control console allows for increased operator space and control while decreasing the necessary spatial requirements for the cab. Additionally, the operating position of the tower assembly provides easy access to the controller so that operator fatigue is reduced.

BEST MODE FOR CARRYING OUT THE INVENTION

Figure 1:
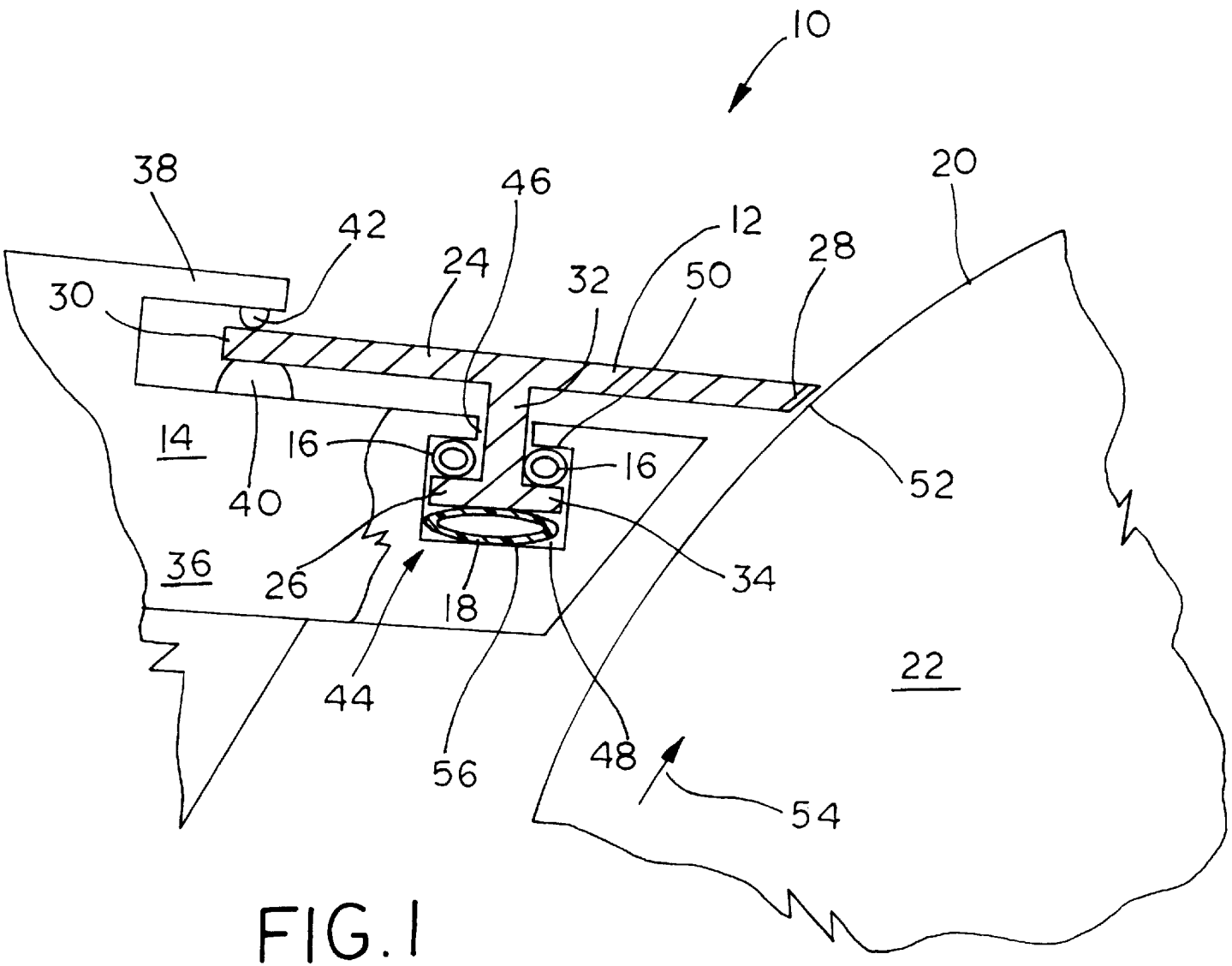
FIG. 1 is a perspective view of a backhoe loader machine including the tiltable control console of the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
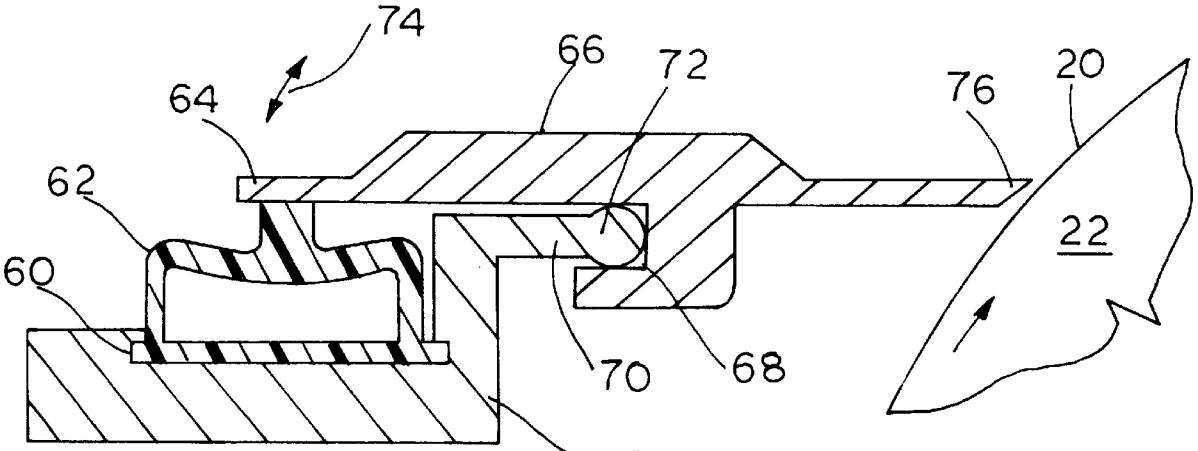
FIG. 2 is a partial, perspective view taken from the rear of a backhoe loader machine showing an operator utilizing the present invention.
Figure 4:
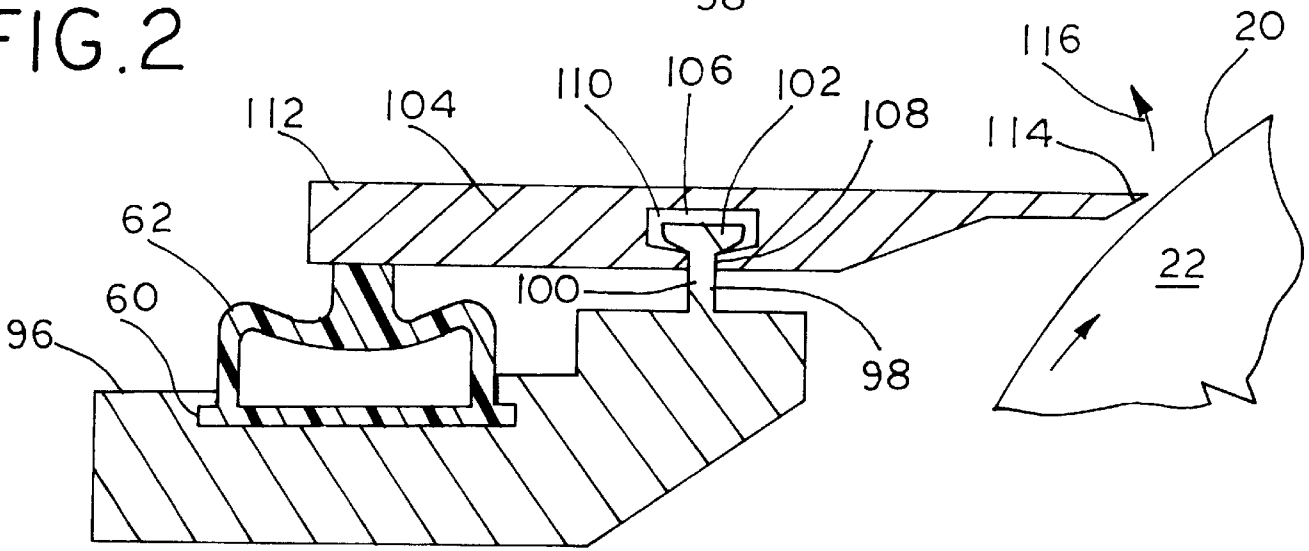
FIGS. 3–4 are partial, perspective views of a cab of the backhoe loader machine, taken from the front and rear thereof, respectively, featuring a seat therein (shown in a front position) facing away from the present invention (shown in a stowed position)
Figure 3:
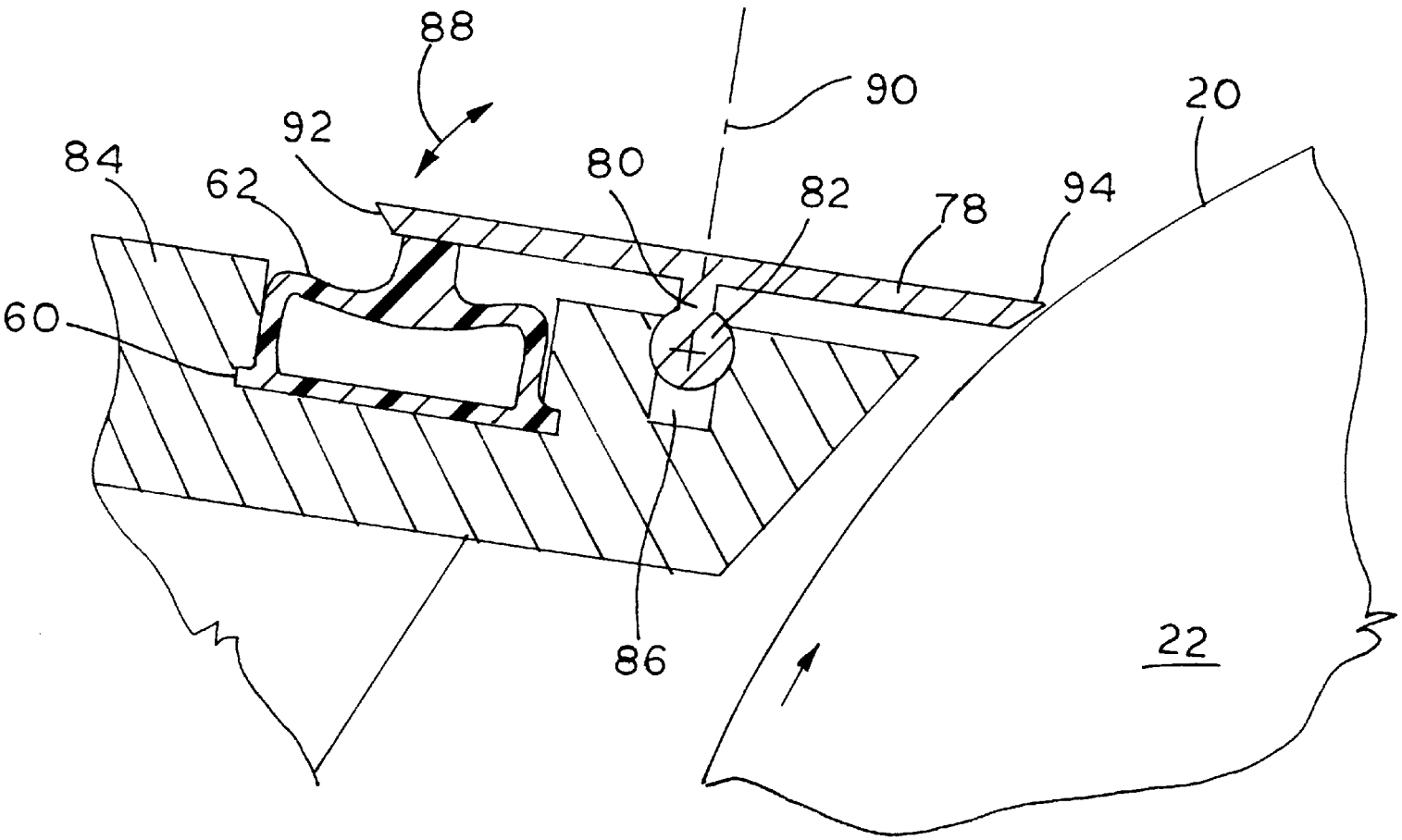
Figure 5:
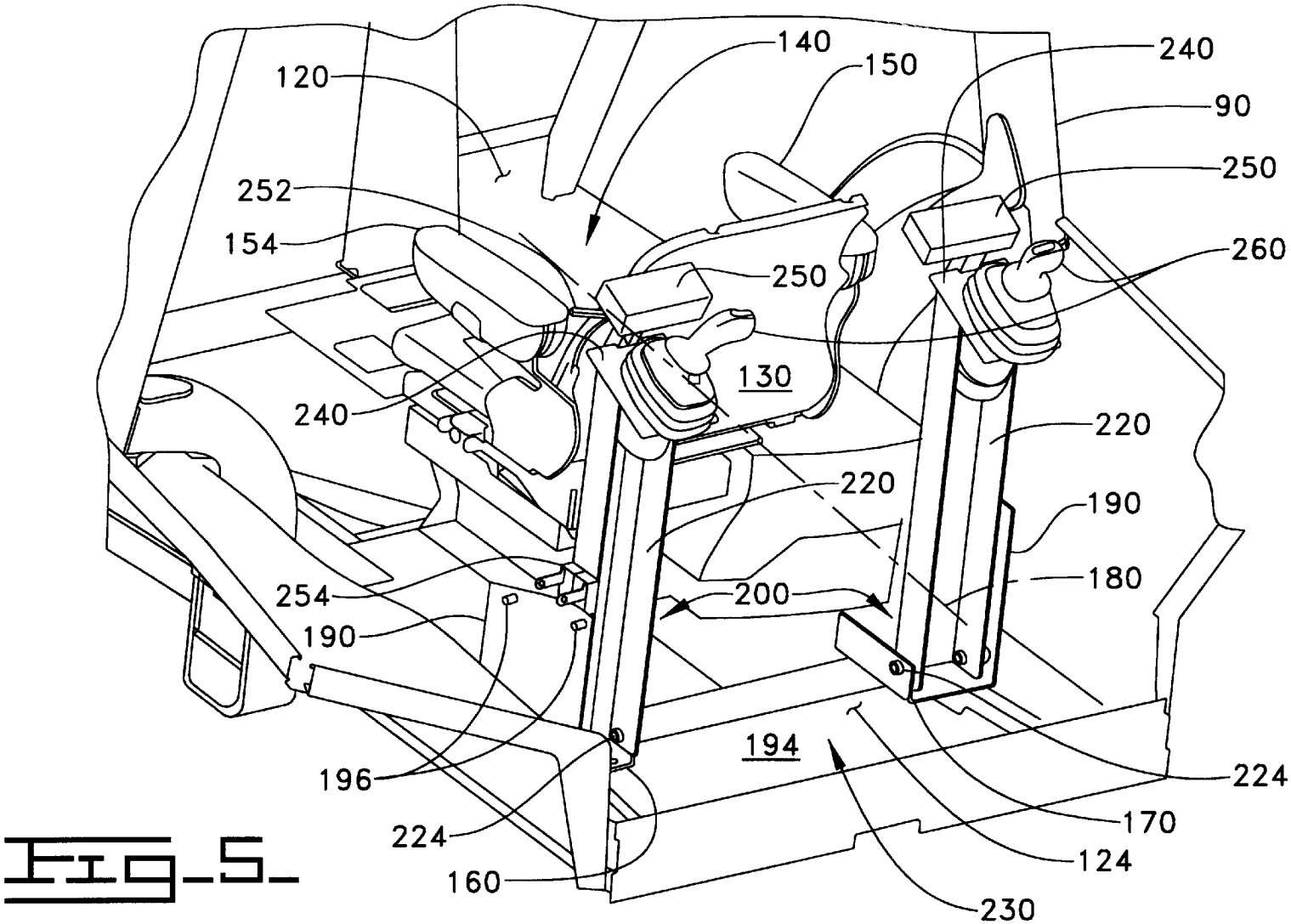
FIG. 5 is a partial, perspective close-up views of the cab taken from the rear sides of the backhoe loader machine showing the present invention in the stowed position.

Referring to FIGS. 1–2, a work machine 10, such as a backhoe loader, is shown incorporating the present invention. It should be understood that any other type of work machine utilizing a backhoe loader function at one end of the machine in cooperation with another work function at an opposite end of the machine may also be considered within the scope of the present invention. The work machine 10 includes a frame 20 with front and rear end portions 30,36 supported by a plurality of wheels 40. A lift arm assembly 50 is conventionally mounted to the front end portion 30 of the frame 20 for supporting an attachment 60, such as a loader bucket, in a well-known manner. A boom and stick assembly 70 is conventionally mounted to the rear end portion 36 of the frame 20 for supporting an attachment 80, such as a backhoe bucket, in a well-known manner. A cab 90 is mounted on the frame 20 for partially enclosing an operator 100 within an operating compartment 110. The cab 90 includes front and rear interior portions 120, 124, seen best in FIGS. 3–9, which correspond to the front and rear end portions 30,36, respectively, of the frame 20. A seat 130 is rotatably mounted within the cab 90 for movement between front and rear positions 140,144 and includes a pair of armrests 150, 154. As seen in FIGS. 3–5, the front position 140 of the seat 130 faces the front interior portion 120 of the cab 90 which allows the operator 100 to control specific functions of the loader bucket 60 through conventional control means 64. It should be understood that the control means 64 for the specific functions of the loader bucket 60 are shown only in FIG. 1 and have been removed from the remaining drawings for visual clarity. As seen in FIGS. 6–9, the rear position 144 of the seat 130 faces the rear interior portion 124 of the cab 90 which allows the operator 100 to control specific functions of the backhoe bucket 80 through a pair of control consoles 160, 170. Although a pair of control consoles 160, 170 are shown, it should be understood that the specific functions of the backhoe bucket 80 could be controlled with a single control console. The seat 130 has a centerline 180 parallel with the longitudinal axis (not shown) of the frame 20.

Figure 6:
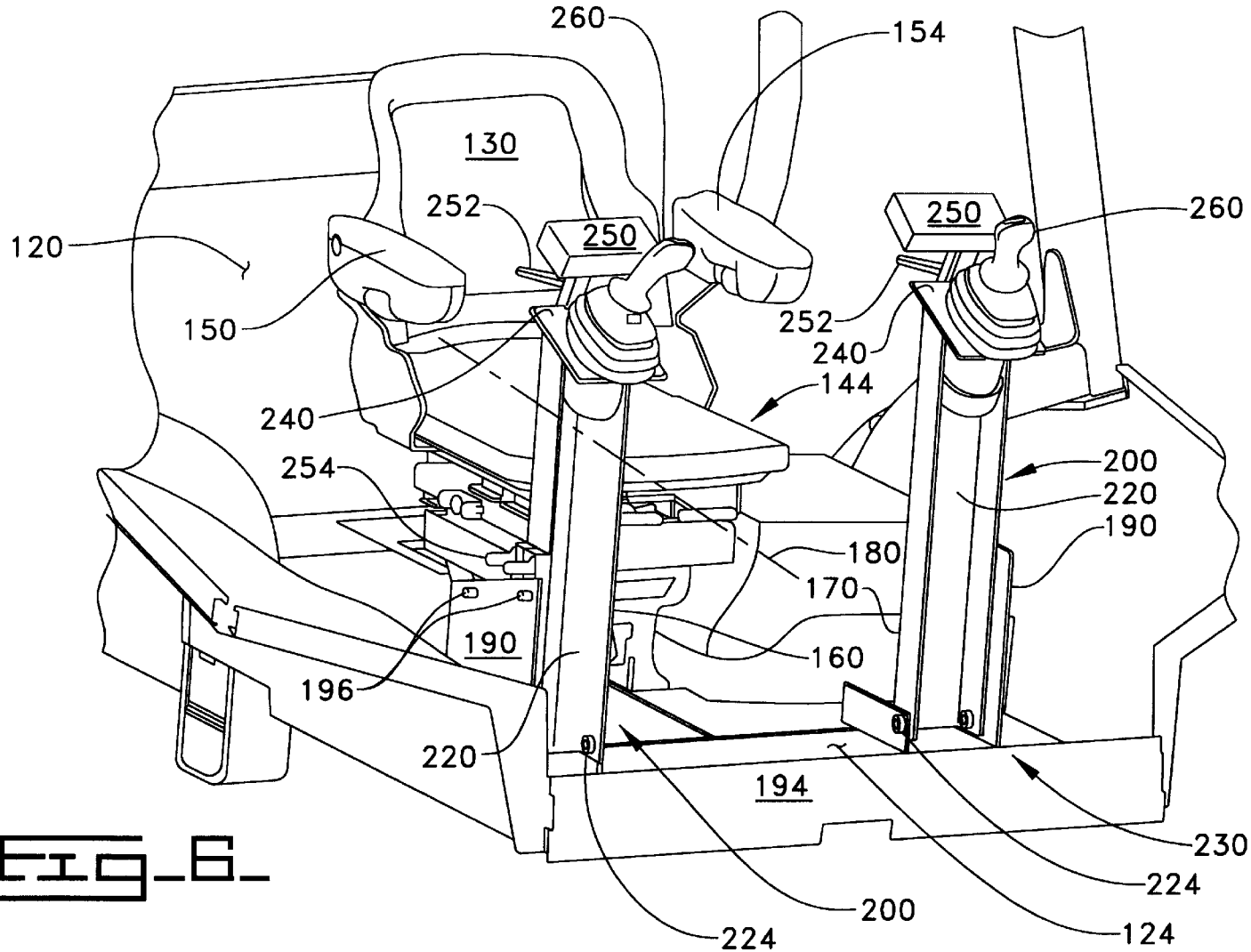
FIGS. 6–7 are partial, perspective close-ups of the cab taken from the rear sides of the backhoe loader machine showing the present invention in the stowed position.
Figure 7:
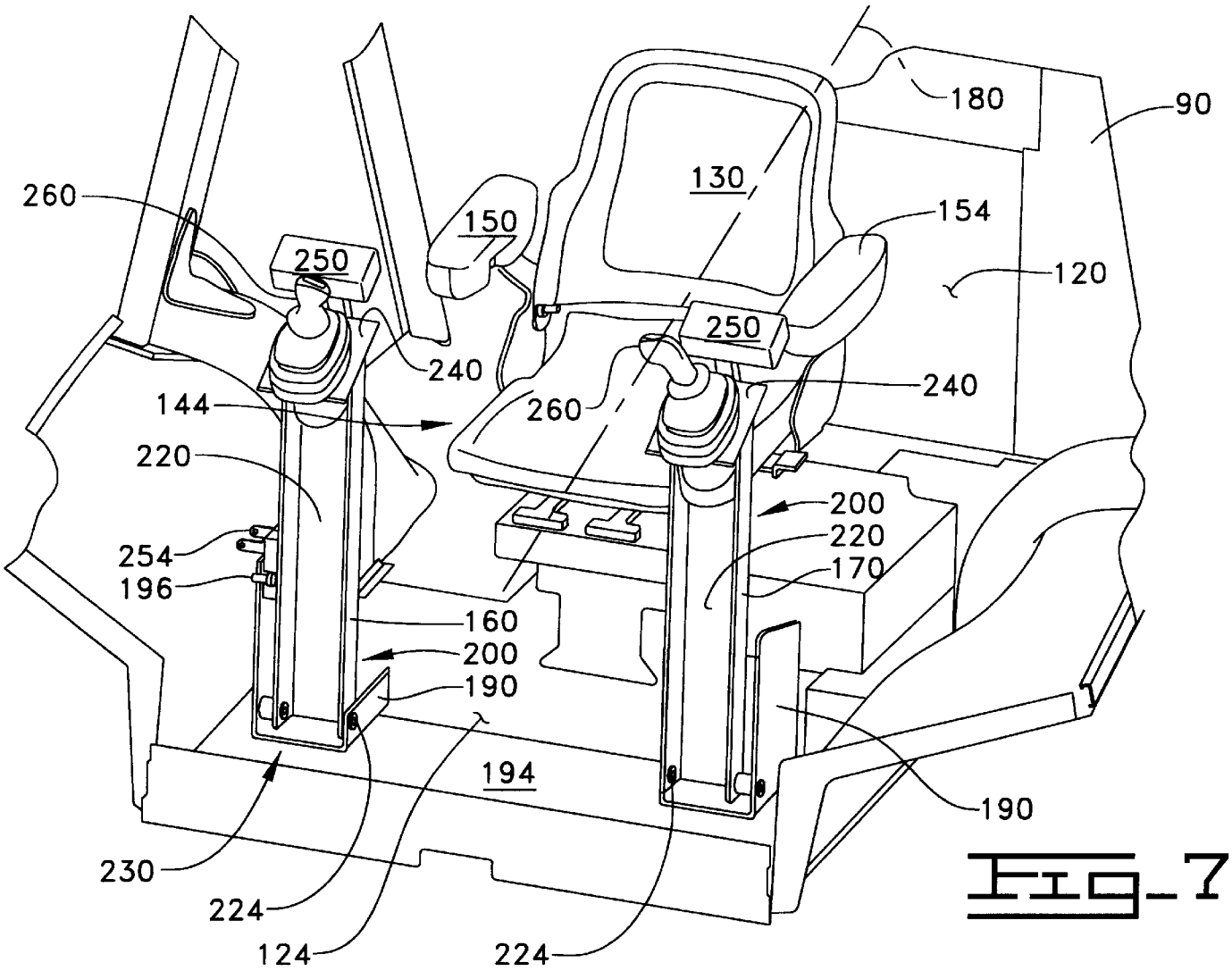
Figure 8:
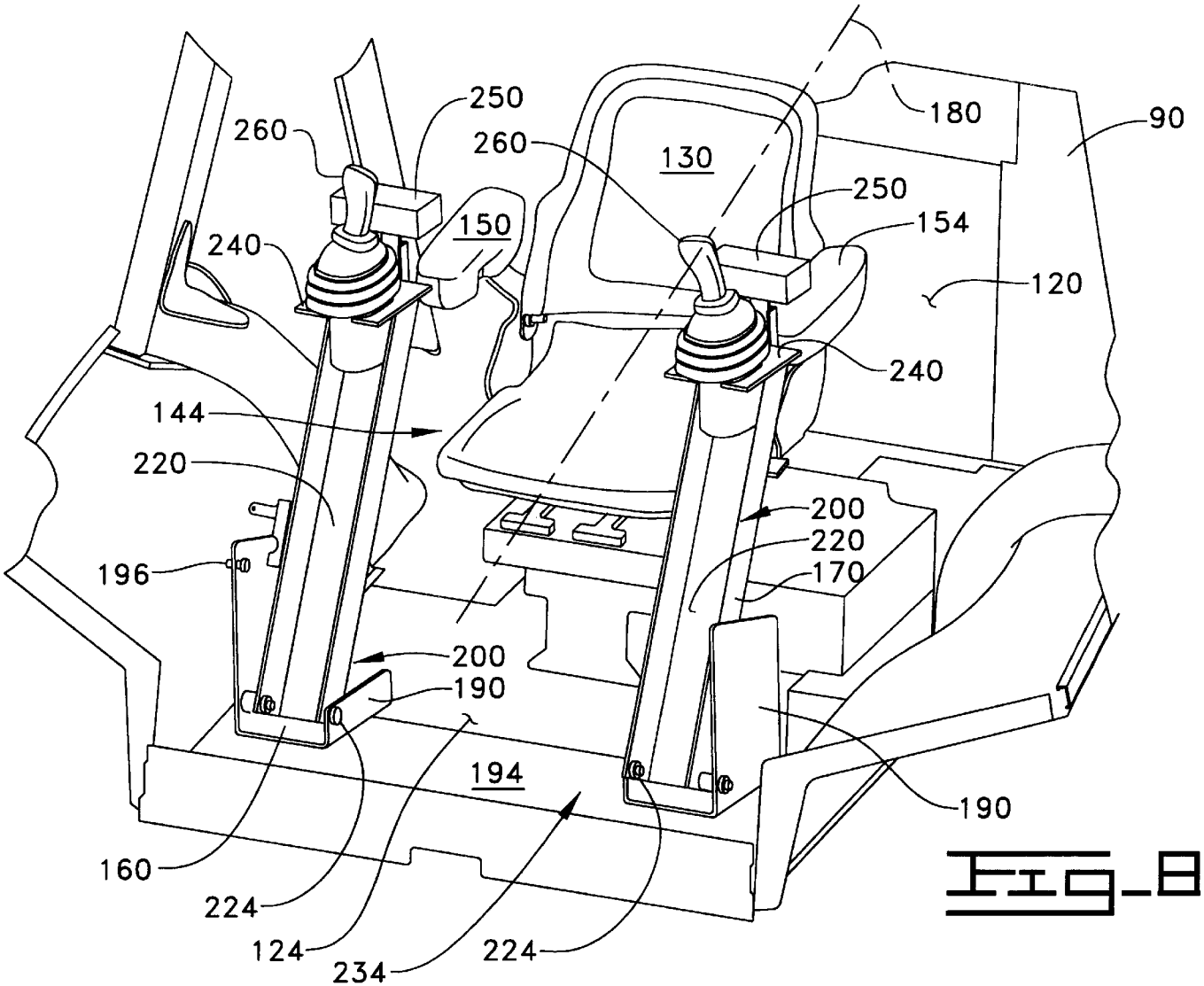
FIGS. 8–9 are partial, perspective close-ups of the cab taken from the rear side of the backhoe loader machine showing the present invention in an operating position, respectively.
Figure 9:
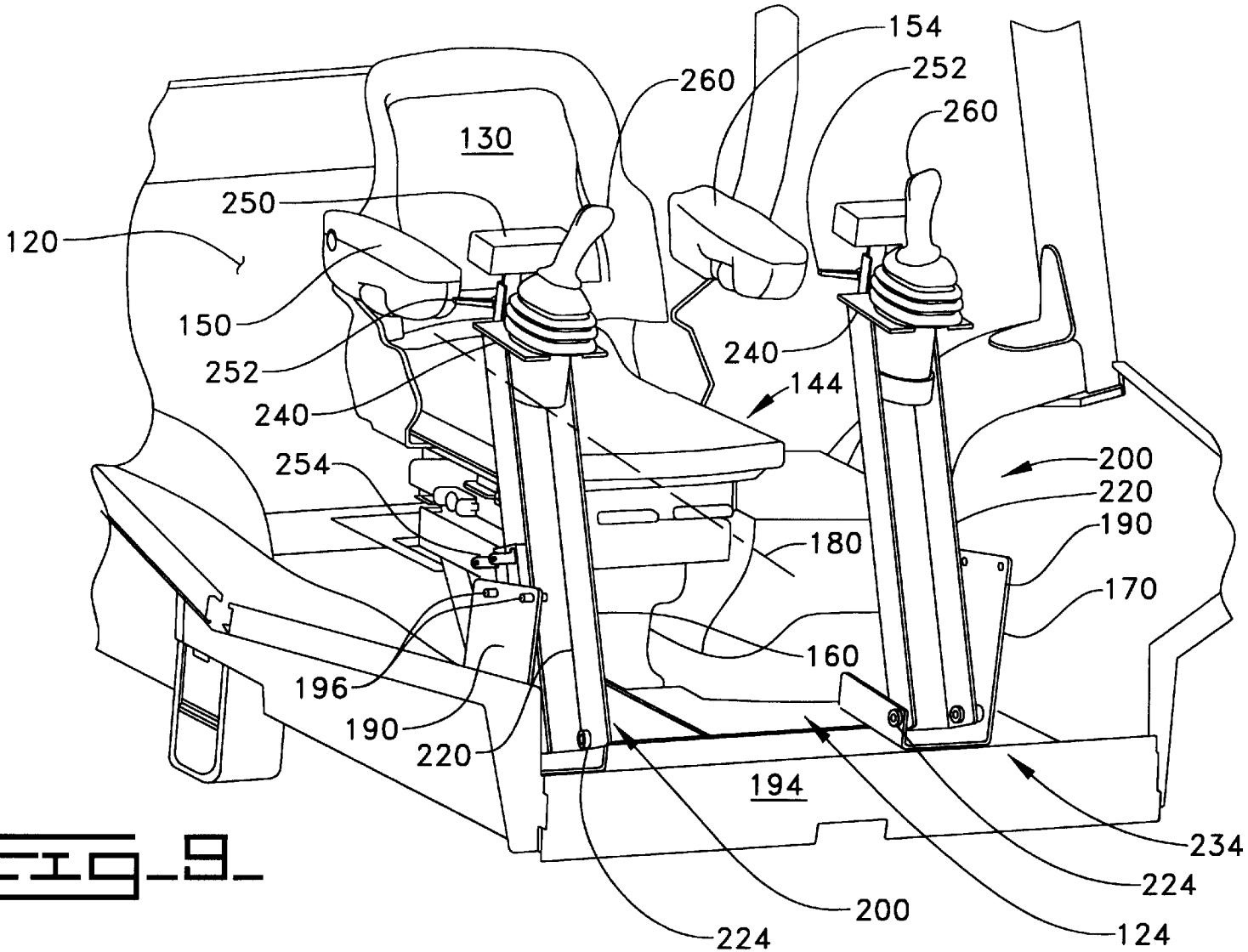
Figure 10:
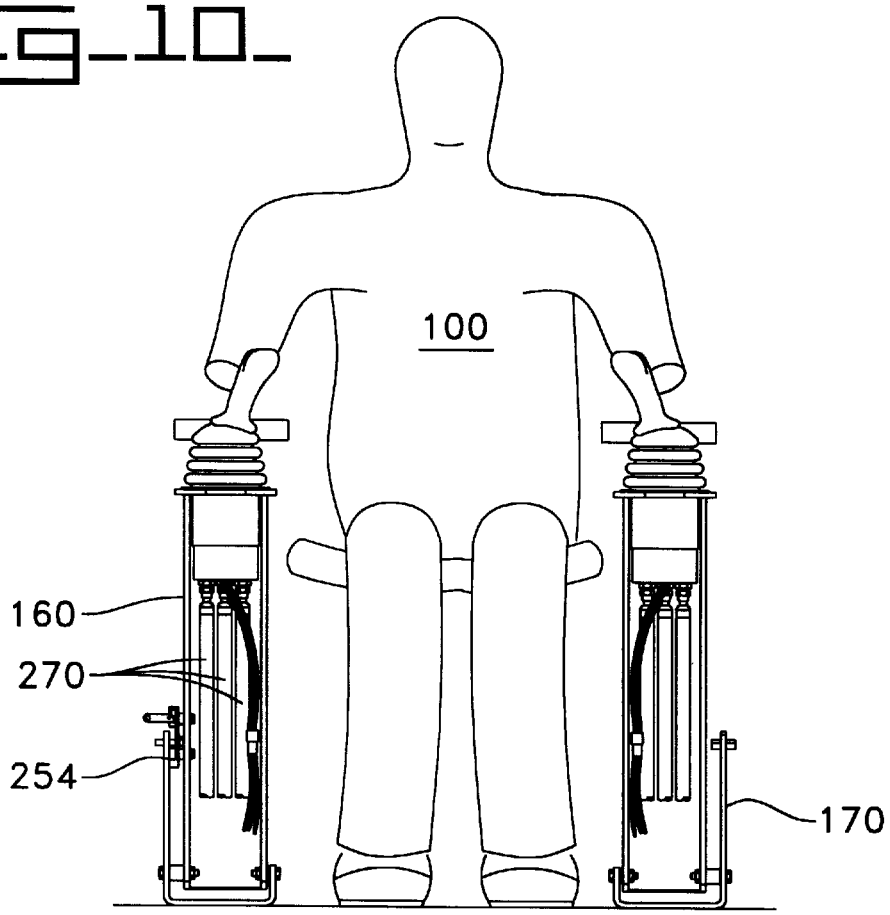
FIG. 10 is a view of the present invention detailing the internal control structure for operating the backhoe loader machine disposed within a tower assembly of the control console.
Figure 11:
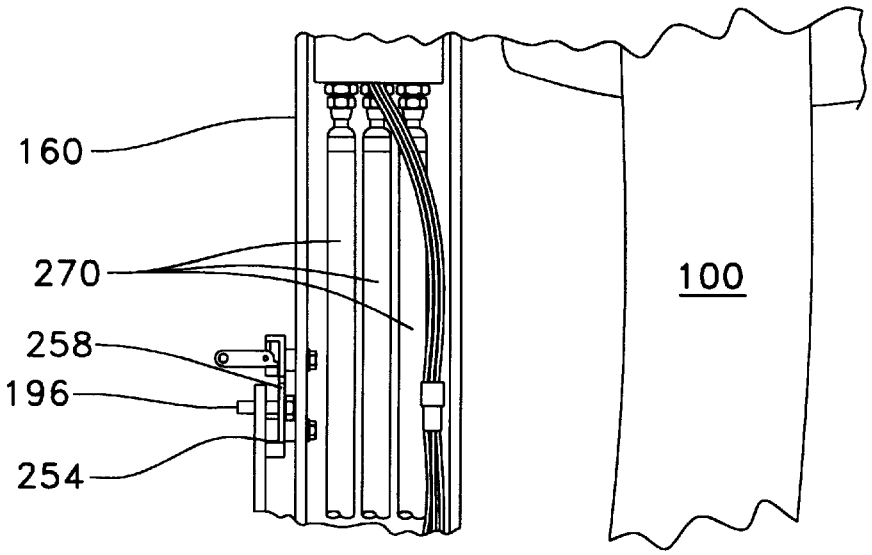
FIGS. 11 is a detail drawing of a latch mechanism used to lock the present invention in the stowed and operating positions.
Figure 12:
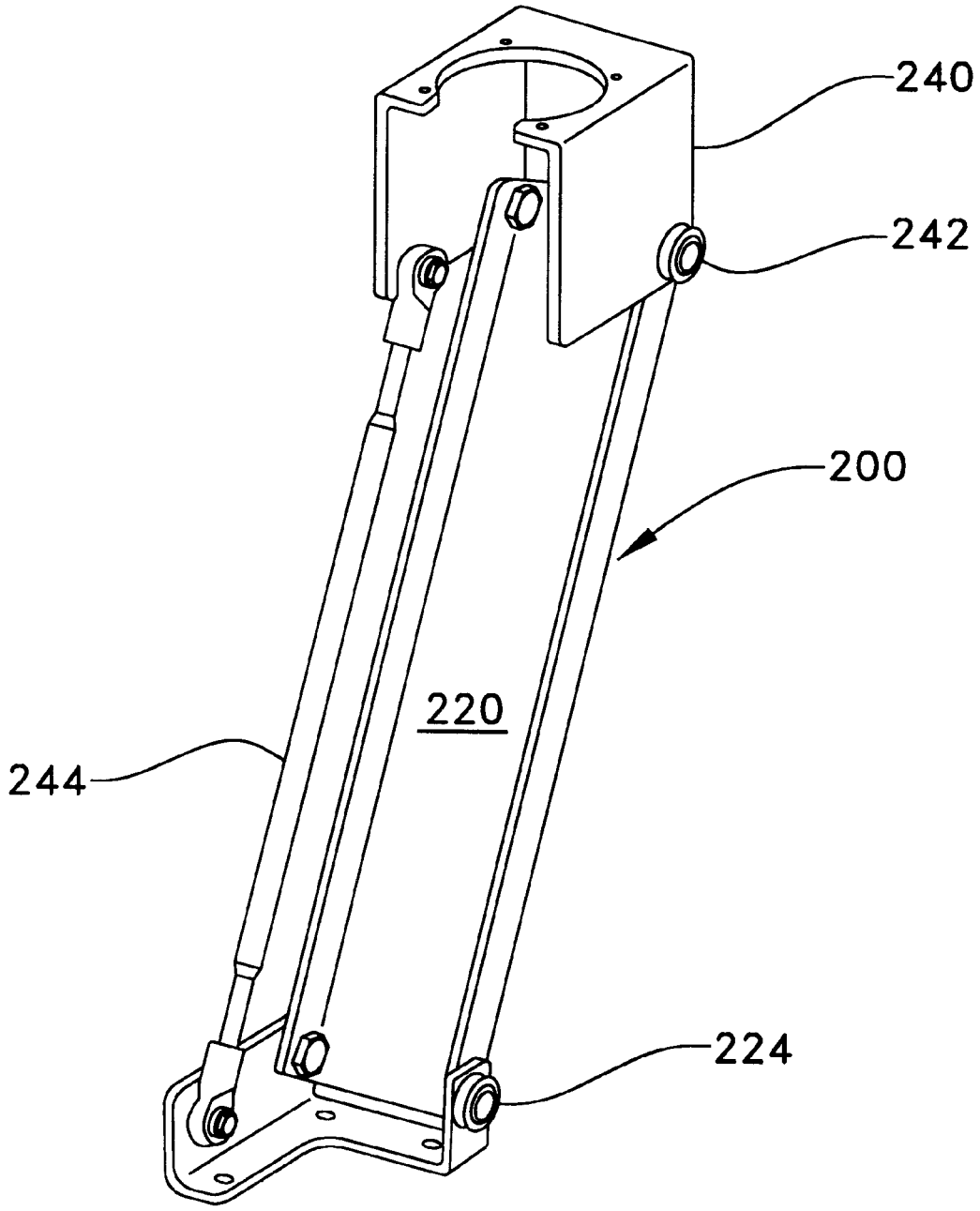
FIG. 12 is a perspective view of an alternative tower assembly of the present invention detailing the various components thereof.
Figure 1:
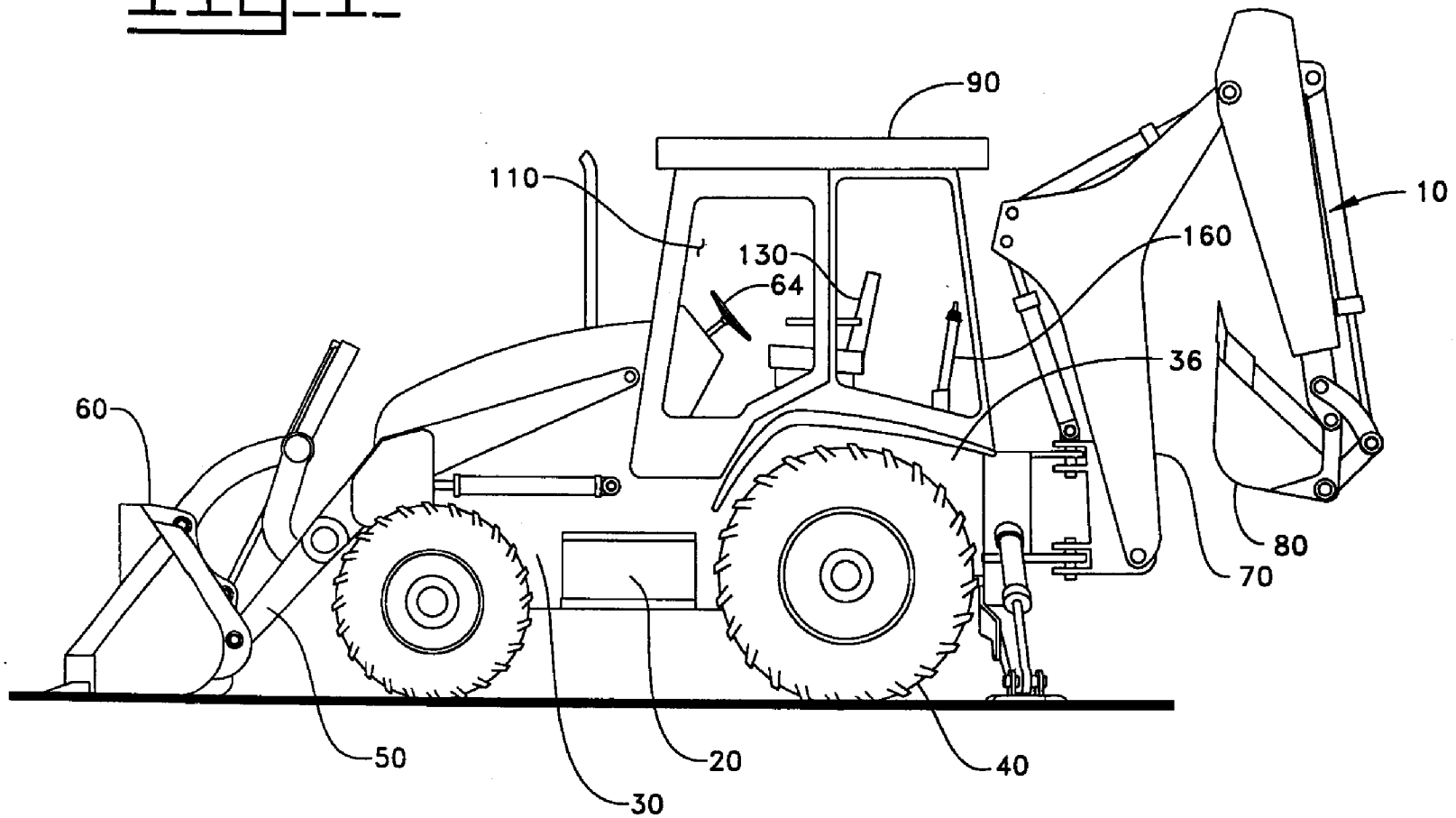
Figure 2:
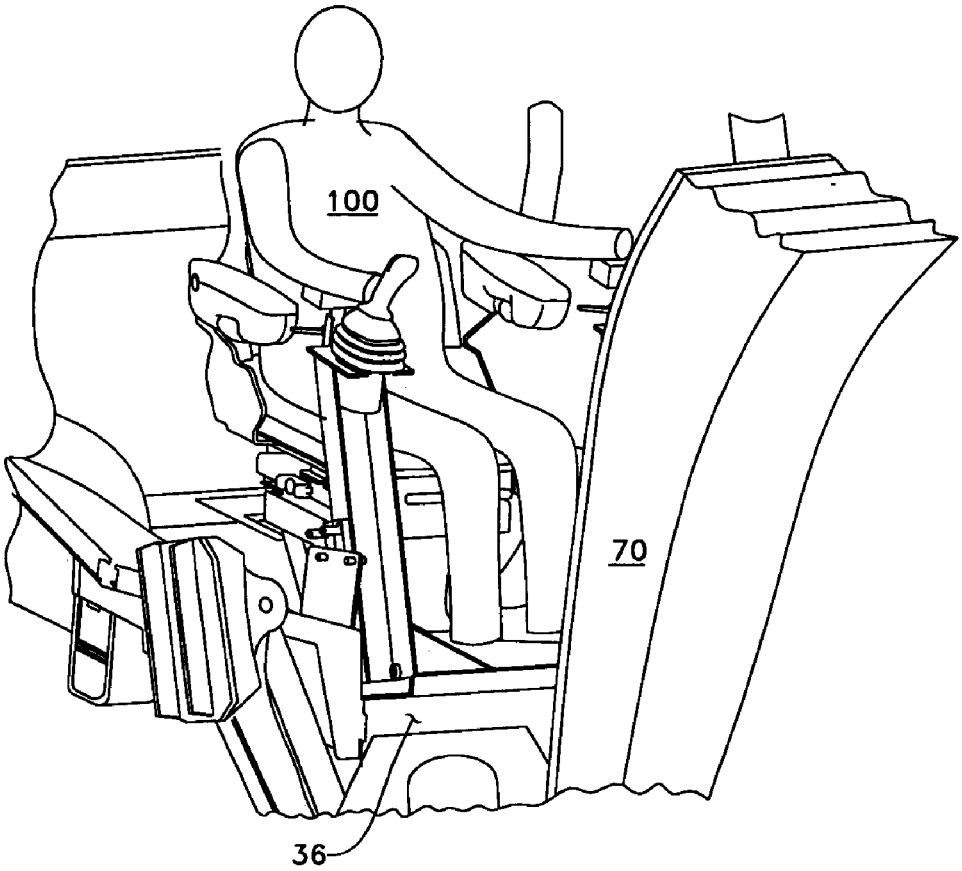
Figure 3:
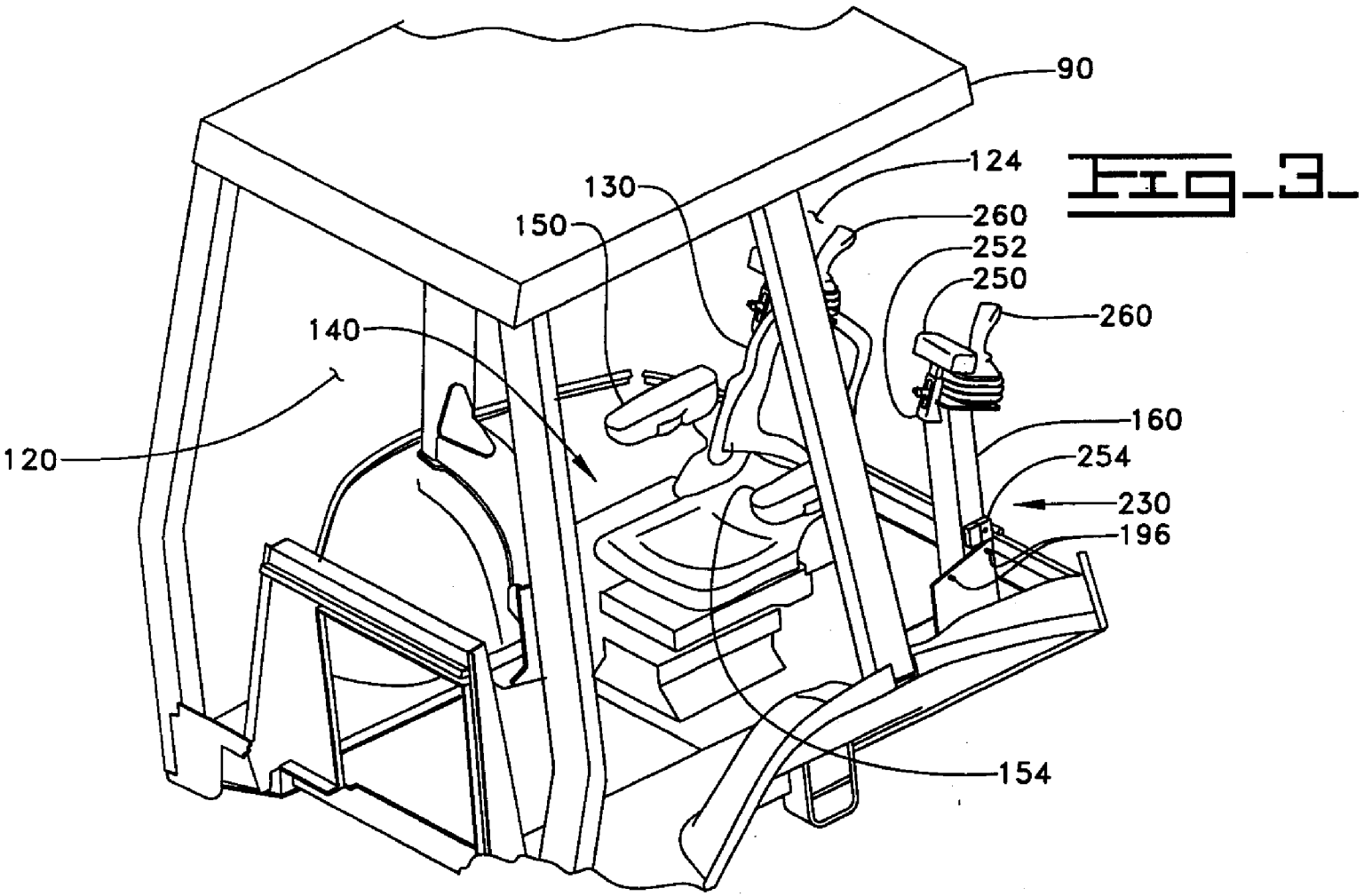
Figure 4:
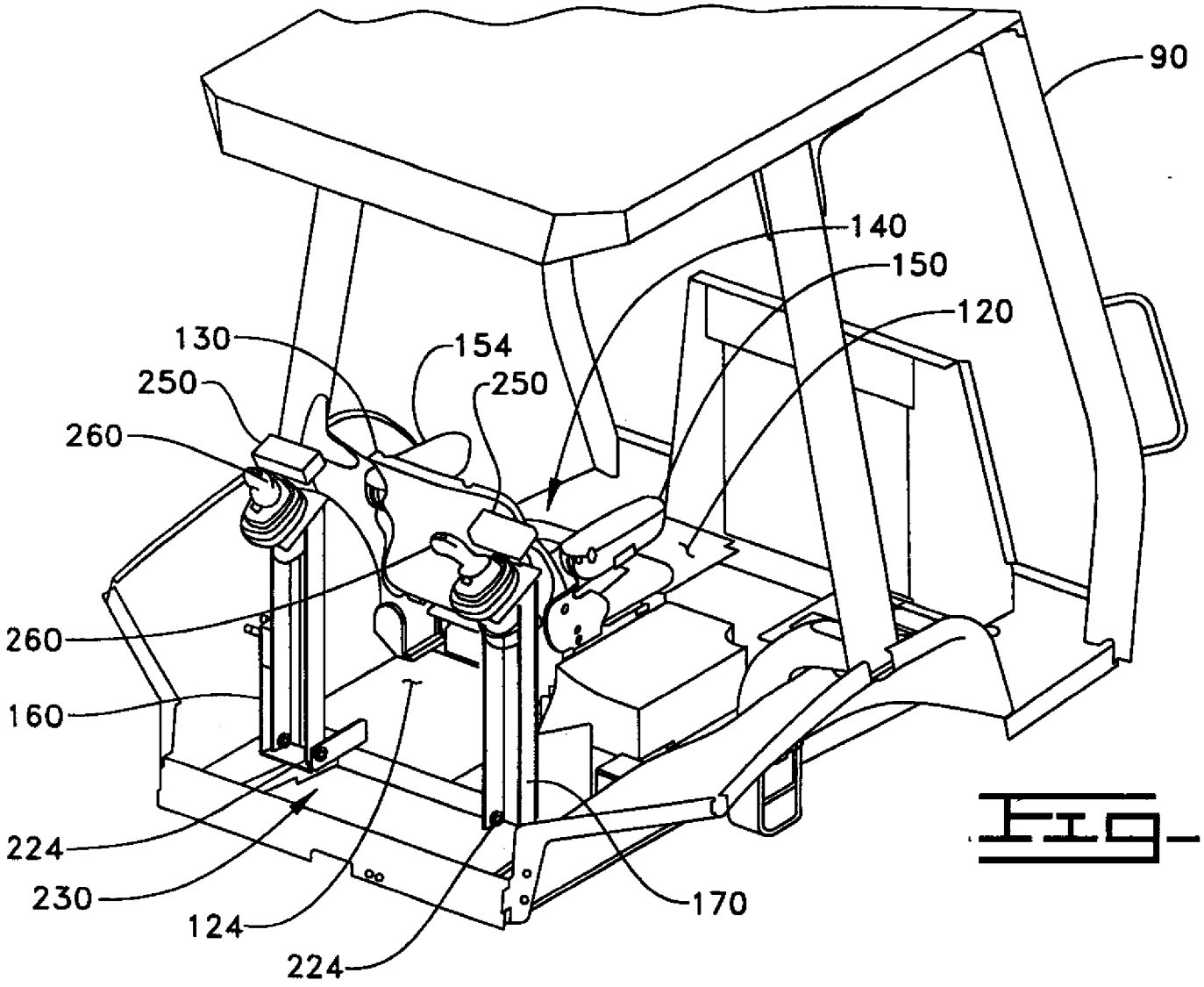
Figure 5:
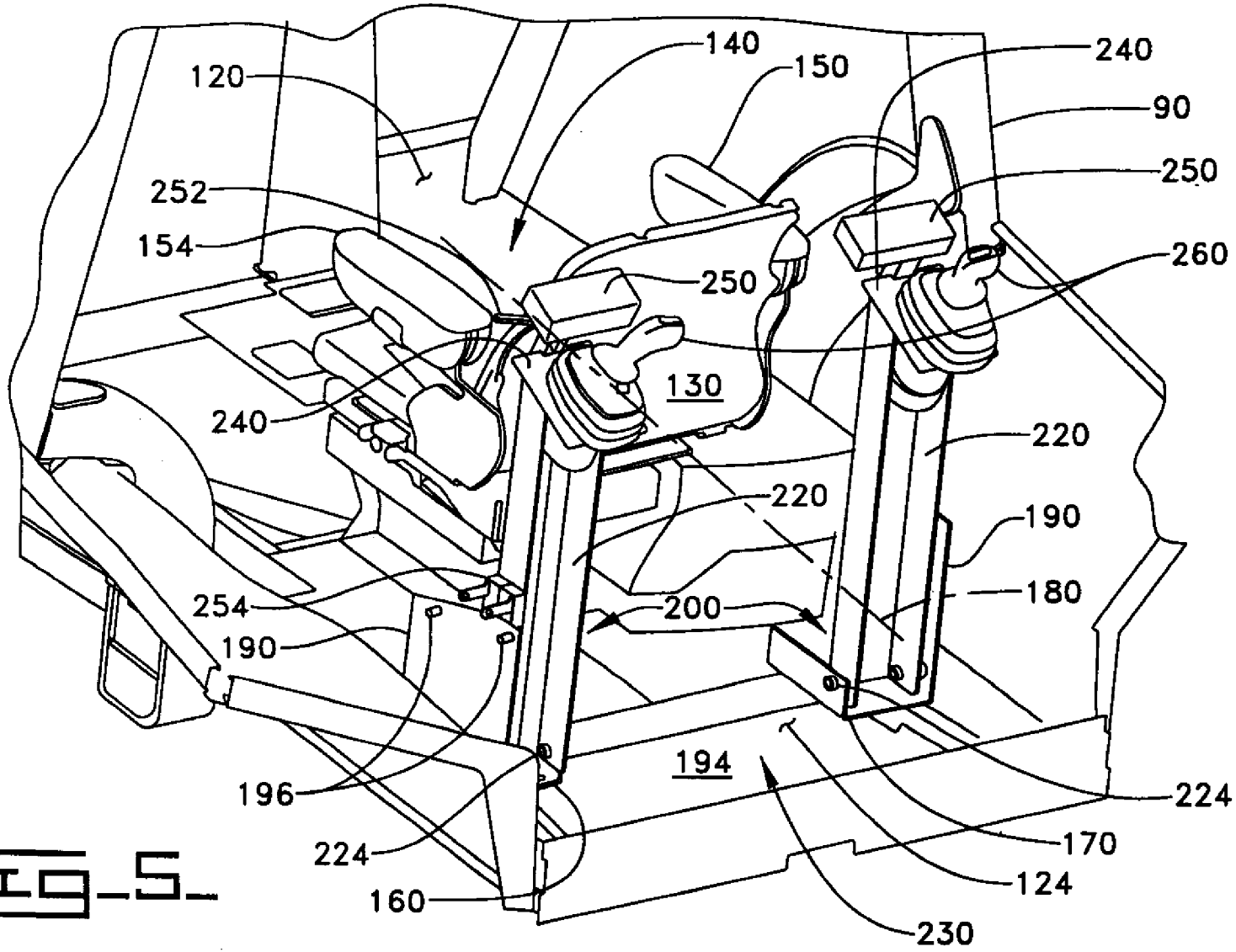
Figure 6:
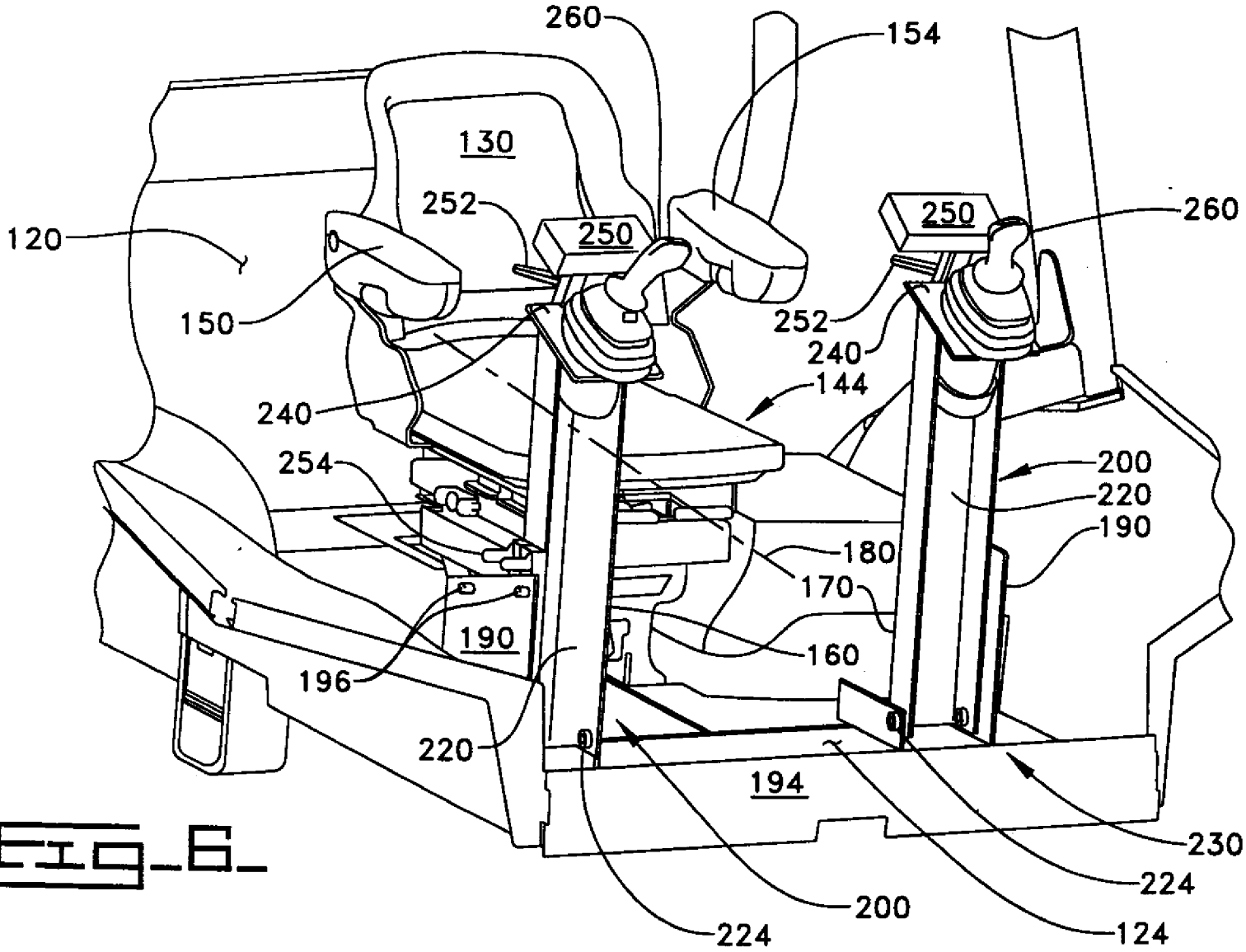
Figure 7:
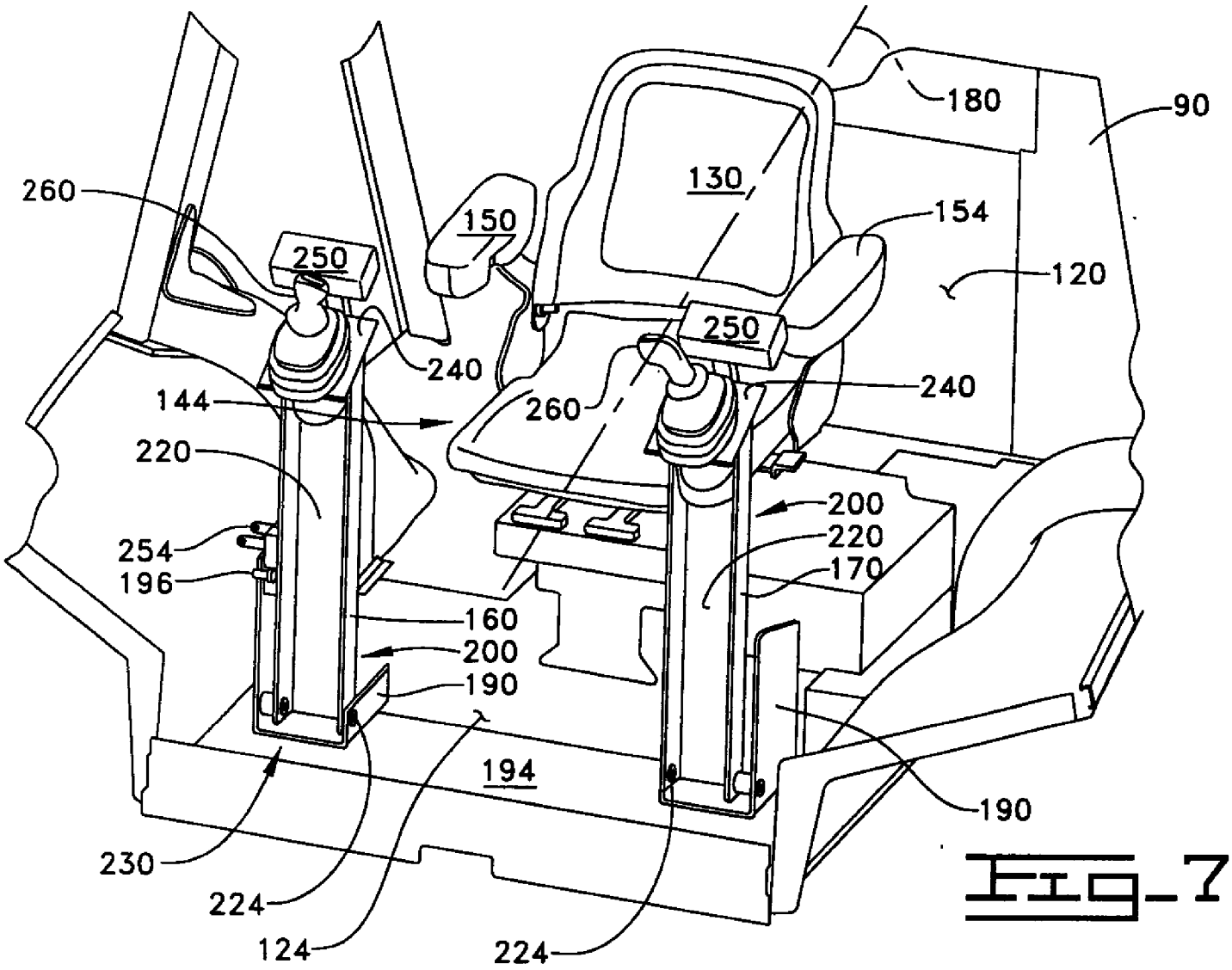
Figure 8:
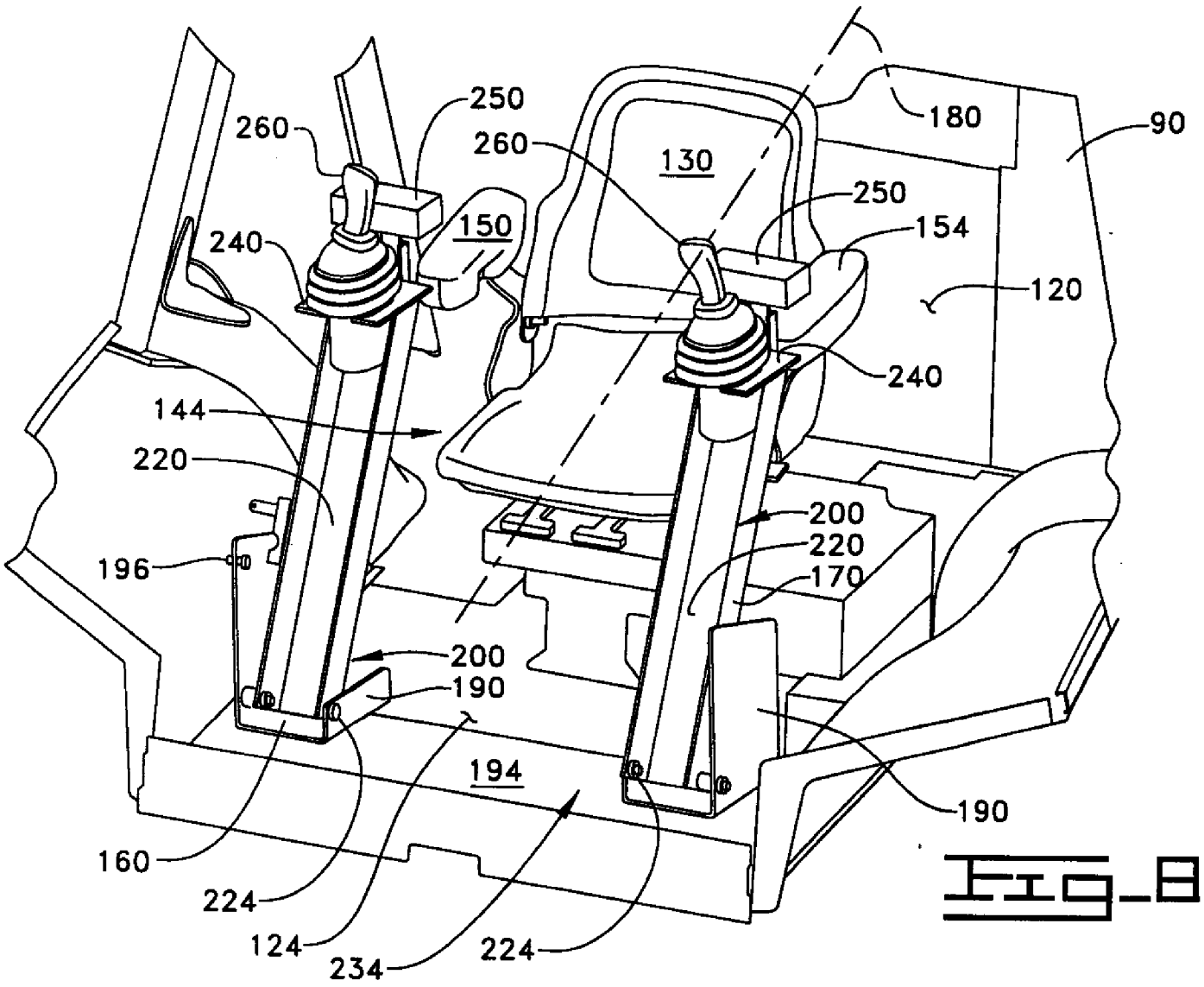
Figure 9:
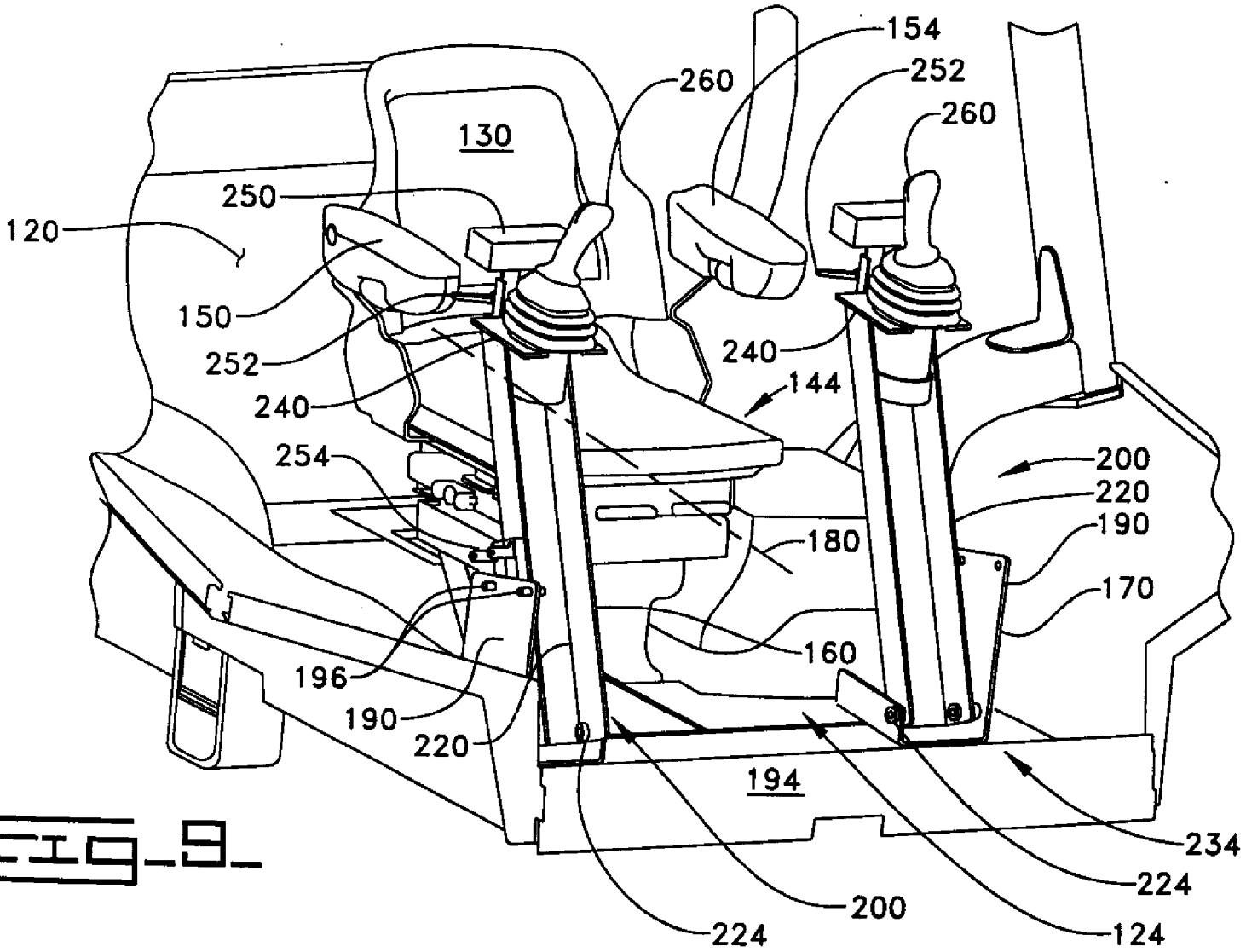
Figure 10:
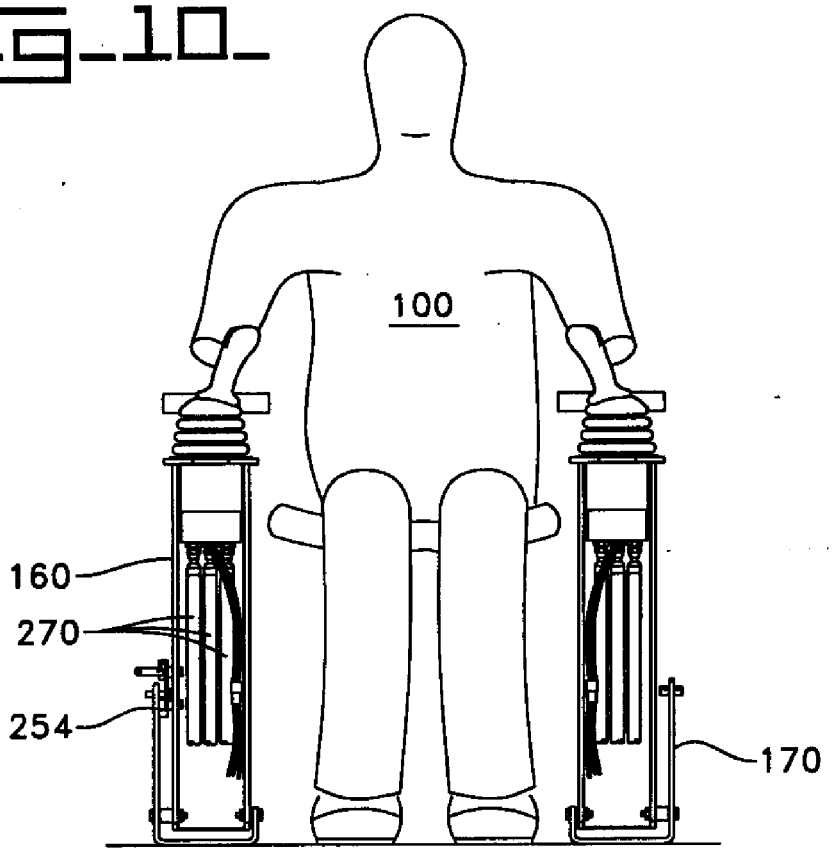
Figure 11:
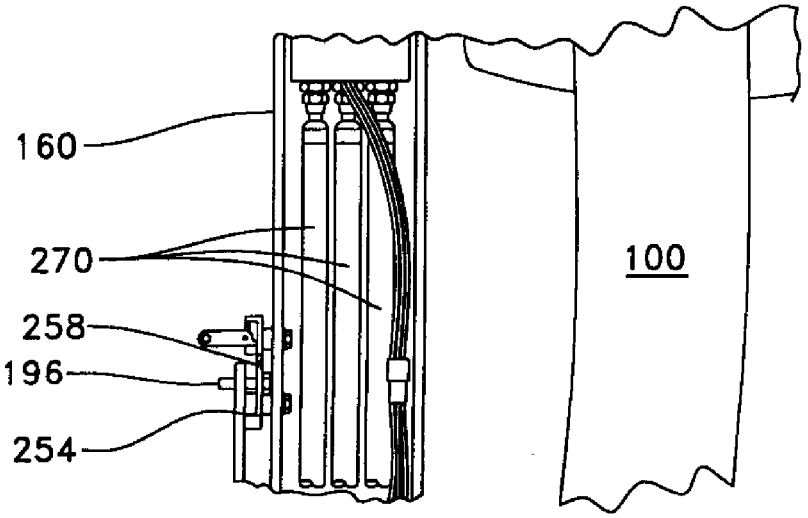
Figure 12:
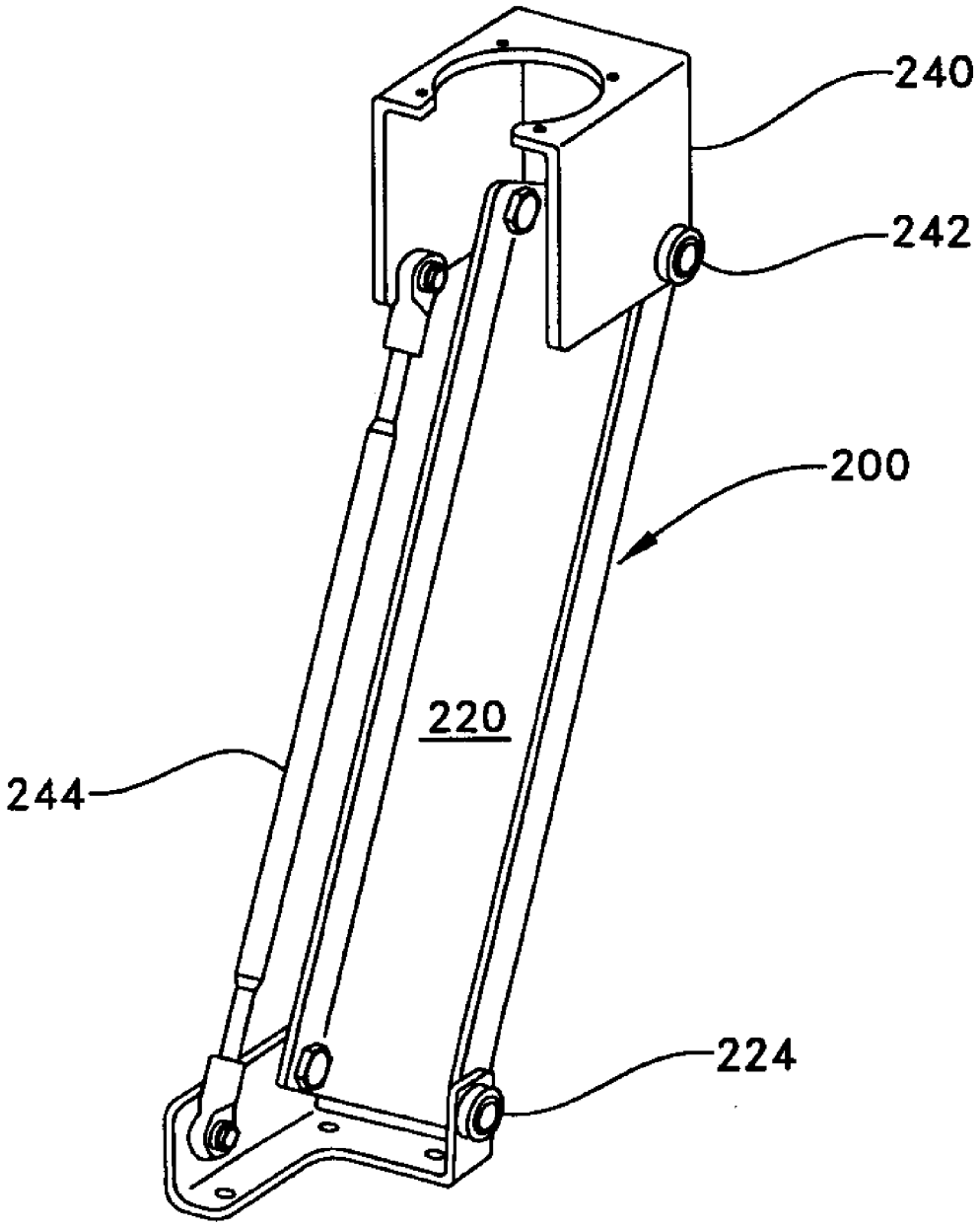

Referring to FIGS. 3–9, the control consoles 160, 170 are positioned within the rear interior portion 124 of the cab 90 on opposite sides of the centerline 180 of the seat 130. For simplicity and ease of understanding, only one control console 160 will be discussed in detail. It should be understood that the components for the control consoles 160, 170 are identical although the control consoles 160, 170 may control different specific functions of the backhoe bucket 80. Therefore, reference numerals used to designate components of control console 160 will also be used to designate the same components of control console 170. It should also be understood that some components of control console 170 may not be shown in the drawings, however, all components of control console 160 can be utilized on control console 170. The control console 160 includes a base 190 fixedly mounted to a floor 194 of the cab 90 and a tower assembly 200, seen best in FIGS. 5–9. The base 190 includes an elongated side wall portion with a pair of pins 196 extending therefrom, such as a striker bolt, seen best in FIG. 7. The tower assembly 200 includes an elongated, channel shaped tower 220 pivotally connected at a lower portion thereof to the base 190 in any suitable manner, such as through the utilization of pivot pin joints 224. The tower 220 defines stowed and operating positions 230, 234 of the control console 160, seen best in FIGS. 6 & 9, respectively, when pivoted about the base 190. It should be understood that although only one operating position is shown for the control console 160, it is possible that a plurality of operating positions may be utilized with the present invention. The tower assembly 200 also includes a control mounting platform 240 fixedly connected to an upper portion of the tower 220 for movement therewith. It should be understood that the control mounting platform 240 may also include adjustable movement, as seen in the alternative design of FIG. 12. For instance, the control mounting platform 240 may be pivotally connected to the upper portion of the tower 220 in any suitable manner, such as pivot pin joints 242. A linkage rod 244 is pivotally connected in any suitable manner at a first end to the base 190 and at a second end to the control mounting platform 240 to establish a substantial parallelogram structure. The pivotal connections on the alternative design of FIG. 12 allow the control mounting platform 240 to adjust to any desired position by the operator 100. As can be seen in FIG. 6, a wristrest assembly 250 is fixedly mounted on the tower 220 and is adjustable in any suitable manner, such as a mechanical adjuster 252, to individually fit the operator 100. The wristrest assembly 250 is mounted on the tower 220 so that it is adjacent the seat 130 when the control console 160 is in the operating position 234. It should be understood that the wristrest assembly 250 may not be used with the present invention to accommodate various operators (not shown). A double latch mechanism 254 is seen best in FIGS. 5, 9, and 11 and includes a pair of opposed latches, one of which is shown at 258 in FIG. 18. The latch mechanism 254 is fixedly mounted to the tower 220 and operates in any suitable manner so that a respective one of the pins 196 is captured by a respective latch 258 to lock the control console 160 in the respective stowed or operating positions 230, 234. It should be understood that although only one latch mechanism 254 is shown in the drawings for control console 160, a latch mechanism 254 could be utilized on control console 170 to achieve the same function.

Referring to FIGS. 5–10, the control console 160 also includes a controller 260, such as a joystick, fixedly mounted to the control mounting platform 240. The controller 260 utilizes pilot hydraulics to control the specific functions of the backhoe bucket 80 through a plurality of hydraulic lines 270, seen only in FIGS. 10–11. It should be understood that the hydraulic lines 270 have been removed from the remaining drawings for visual clarity. The hydraulic lines 270 are disposed within an interior region of the tower 220 for connection with the controller 260. Although not described in detail, it should be understood that the controller 260 operates in a well-known manner to hydraulically actuate a plurality of spool valves (not shown) via hydraulic lines 270. Although hydraulic actuation of spool valves (not shown) is well-known to control various machine functions, it should be understood that the application of pilot hydraulics to control the specific backhoe bucket functions of a backhoe loader machine (10) is not well-known. Although pilot hydraulics are utilized in the drawings, it should also be understood that any suitable operating controls, such as mechanical, electro-hydraulic, and the like, are within the scope of the present invention.

Industrial Applicability

During operation of the work machine 10, it may be necessary for the operator 100 to operate both the controls for the specific functions of the loader bucket 60 and the controls for the specific functions of the backhoe bucket 80. The tiltable control consoles 160, 170 are provided so that during operation of the specific functions of the loader bucket 60, the control consoles 160, 170 may be maintained in the stowed position 230 which is locked in place through the well-known action of one of the pair of latches 258. When the operator 100 rotates the seat 130 from the front position 140 to the rear position 144 for operating the specific functions of the backhoe bucket 80, the stowed position 230 establishes a clearance space between the seat 130 and the controllers 260 so that the operator 100 has sufficient leg room during seat repositioning. The control consoles 160, 170 are then moved to the operating position 234 by releasing the latch 258 from the respective pin 196 (seen best in FIG. 8) and pivotally moving the tower 220 until the other one of the pair of latches 258 acts in a well-known manner to lock the control consoles 160, 170 in place. The operating position 234 of the control consoles 160, 170 establishes a working space between the seat 130 and the controllers 260 wherein both legs of the operator 100 are between the control consoles 160, 170 for increased operator visibility from the rear of the work machine 10. The operating position 234 locates the controllers 260 and wristrest 250 adjacent the respective armrests 150, 154 of the seat 130 so that the operator's arms may simultaneously rest on the armrest 150, 154 and the wristrests 250 so that the operator 100 may easily hand operate the controllers 260. However, it should be understood that the operator 100 may prefer to not use the wristrests 250 and they may be removed without limiting the scope of the invention. Also, it should be understood that the operator 100 may utilize and operate the controllers 260 while the seat is in the front position 140 or if the control consoles 160, 170 are in either of the stowed or operating positions 230, 234, dependent on the needs of the operator 100 during operation of the work machine 10. The ability to move the control consoles 160, 170 to the operating position 234 eliminates additional positioning of the operator 100 thereby decreasing the spatial requirements of the cab 90. Additionally, the operating position 234 ergonomically locates the controllers 260 so that the operator 100 may easily control the specific functions of the backhoe bucket 80 with less fatigue than in conventional designs. Once the control consoles 160, 170 are in the operating positions 234, the operator 100 may move the controllers 260 either separately or simultaneously to actuate the spool valves (not shown) through the incorporation of pilot hydraulic controls to achieve the desired specific functions of the backhoe bucket 80. The ability to utilize pilot hydraulic controls for this purpose increases the sensitivity of the control function and allows for more precise movement of the backhoe bucket 80.

Other aspects, objects and advantages of this invention can be obtained from a study of the drawings, disclosure and the appended claims.

What is claimed is:

1. A tiltable control console for use on a backhoe loader machine having a frame with front and rear interior portions, and a seat positioned on the frame and rotatably mounted thereto for movement between front and rear positions and having a centerline, comprising:

a tower assembly positionable within the rear interior portion of the frame and tiltably mountable therewith for movement between stowed and operating positions; and a controller connected with the tower assembly for operating specific functions of the backhoe loader machine, the controller being utilized to operate the backhoe loader machine when the tower assembly is in one of the operating and stowed positions and the seat is located in any position between the front and rear positions.

2. The tiltable control console for use with a backhoe loader machine of claim 1, wherein the tower assembly and controller are positioned on one side of the centerline of the seat.

3. The tiltable control console for use with a backhoe loader machine of claim 1, wherein the stowed position of the tower assembly defines a predetermined space between the seat and the controller and the operating position of the tower assembly defines a predetermined space between the seat and the controller that is less than the predetermined space defined by the stowed position of the tower assembly.

4. The tiltable control console for use with a backhoe loader machine of claim 1, wherein the controller is positioned adjacent a predetermined portion of the seat when the tower assembly is in the operating position.

5. The tiltable control console for use with a backhoe loader machine of claim 1, wherein the controller operates the specific functions of the backhoe loader machine through an incorporation of pilot hydraulic controls.

6. The tiltable control console for use with a backhoe loader machine of claim 1, including a second tower assembly positionable within the rear interior portion of the frame and tiltably mountable therewith for movement between stowed and operating positions and a second controller connected with the second tower assembly for operating additional specific functions of the backhoe loader machine, the second controller being utilized to operate the backhoe loader machine when the second tower assembly is in one of the operating and stowed positions and the seat is located in any position between the front position and rear positions.

7. The tiltable control console for use with a backhoe loader machine of claim 6, wherein the stowed position of the second tower assembly defines a predetermined space between the seat and the second controller and the operating position of the tower assembly defines a predetermined space between the seat and the second controller that is less than the predetermined space defined by the stowed position of the tower assembly.

8. The tiltable control console for use with a backhoe loader machine of claim 6, wherein the second controller is positioned adjacent a predetermined portion of the seat when the second tower assembly is in the operating position.

9. The tiltable control console for use with a backhoe loader machine of claim 6, wherein the first tower assembly and controller are positioned on one side of the centerline of the seat and the second tower assembly and controller are positioned on the other side of the centerline of the seat opposite the first tower assembly and controller.

10. The tiltable control console for use with a backhoe loader machine of claim 9, wherein the first and second controllers are operatively associated for operating the respective specific functions of the backhoe loader machine, the first and second controllers being utilized to operate the backhoe loader machine when the first and second tower assemblies are in one of the operating and stowed positions and the seat is located in any position between the front and rear positions and being simultaneously utilized to operate the backhoe loader machine when the first and second tower assemblies are in the operating positions and the seat is located in the rear position.

11. The tiltable control console for use with a backhoe loader machine of claim 10, wherein the stowed positions of the first and second tower assemblies define a predetermined space between the seat and the respective first and second controllers and the operating positions of the first and second tower assemblies define a predetermined space between the seat and the respective first and second controllers that is less than the predetermined space defined by the stowed positions of the first and second tower assemblies.

12. The tiltable control console for use with a backhoe loader machine of claim 10, wherein the first and second controllers are positioned adjacent a predetermined portion of the seat when the respective first and second tower assemblies are in the operating position.

13. The tiltable control console for use with a backhoe loader machine of claim 10, wherein the first and second controllers operate the respective specific functions of the backhoe loader machine through the incorporation of pilot hydraulic controls.

* * * * *

UNITED STATES PATENT AND TRADEMARK OFFICE

CERTIFICATE OF CORRECTION

PATENT NO. : 6,564,896 B1
DATED : May 20, 2003
INVENTOR(S) : Proksch et al.

It is certified that error appears in the above-identified patent and that said Letters Patent is hereby corrected as shown below:

Title page,
Item [56], References Cited, U.S. PATENT DOCUMENTS, add the following reference
-- 4,478,308 10/1984 Klaassen --
FOREIGN PATENT DOCUMENTS, add the following references
-- JP 8027839 1/1996
JP 9165787 6/1997 --

Signed and Sealed this

Thirteenth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,564,896 B1
DATED : May 20, 2003
INVENTOR(S) : Fred D. Proksch et al.

It is certified that error appears in the above-identified patent and that said Letters Patent is hereby corrected as shown below:

Delete the title page and substitute the attached title page.

All the drawing sheets 1/10, 2/10, 3/10, 4/10, 5/10, 6/10, 7/10, 8/10, 9/10, and 10/10 in the patent are to be substituted with the originally filed drawing sheets 1/11, 2/11, 3/11, 4/11, 5/11, 6/11, 7/11, 8/11, 9/11, 10/11, and 11/11.

Title page,
Under Item [57], ABSTRACT, "13 Claims, 10 Drawing Sheets" should be changed to -- 13 Claims, 11 Drawing Sheets --

Signed and Sealed this

Twenty-fourth Day of May, 2005

JON W. DUDAS
*Director of the United States Patent and Trademark Office*

(12) United States Patent
Proksch et al.

(10) Patent No.: US 6,564,896 B1
(45) Date of Patent: May 20, 2003

(54) TILTABLE CONTROL CONSOLE FOR A BACKHOE LOADER MACHINE

(75) Inventors: Fred D. Proksch, deceased, late of Peoria, IL (US), by Patricia A. Proksch, legal representative; Hugh Rillie, Raleigh, NC (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/593,894

(22) Filed: Jun. 14, 2000

Related U.S. Application Data

(60) Provisional application No. 60/140,419, filed on Jun. 22, 1999.

(51) Int. Cl.[7] ..... B62D 1/14

(52) U.S. Cl. ..... 180/326; 180/334; 180/333; 74/493

(58) Field of Search ..... 180/326, 334, 180/272, 324, 331–333; 74/493; 280/775

(56) References Cited

U.S. PATENT DOCUMENTS

| | | | | | |
|---|---|---|---|---|---|
| 3,887,095 | A | * | 6/1975 | Suzuki | 214/130 R |
| 4,140,200 | A | * | 2/1979 | Tucek | 180/77 H |
| 4,158,968 | A | * | 6/1979 | Wilson et al. | 74/471 R |
| 4,278,144 | A | | 7/1981 | Perin | 180/329 |
| 4,821,837 | A | * | 4/1989 | Fifer | 180/334 |
| 4,869,337 | A | | 9/1989 | Wagner | 180/330 |
| 5,002,332 | A | | 3/1991 | Ikeda | 296/190 |
| 5,050,700 | A | * | 9/1991 | Kim | 180/268 |
| 5,110,253 | A | | 5/1992 | Ernst et al. | 414/694 |
| 5,138,756 | A | | 8/1992 | Johnson et al. | 29/401.1 |
| 5,346,035 | A | * | 9/1994 | Ueda et al. | 180/329 |
| 5,409,080 | A | * | 4/1995 | Templeton et al. | 180/326 |
| 5,566,778 | A | * | 10/1996 | Valier et al. | 180/334 |
| 5,664,909 | A | * | 9/1997 | Lindgren et al. | 404/122 |
| 5,732,788 | A | * | 3/1998 | Brown | 180/326 |
| 5,890,562 | A | * | 4/1999 | Bartels et al. | 187/224 |
| 5,921,340 | A | * | 7/1999 | Abels | 180/326 |
| 5,924,515 | A | * | 7/1999 | Stauffer | 180/326 |
| 5,964,313 | A | * | 10/1999 | Guy | 180/332 |
| 6,148,688 | A | * | 11/2000 | Nishimaki | 74/493 |
| 6,148,946 | A | * | 11/2000 | Takahasi et al. | 180/316 |

FOREIGN PATENT DOCUMENTS

GB 2 224 559 A 9/1990

* cited by examiner

*Primary Examiner*—Lesley D. Morris
*Assistant Examiner*—L. Lum
(74) *Attorney, Agent, or Firm*—Diana L Charlton

(57) ABSTRACT

The present invention includes a tiltable control console positioned within a rear interior portion of a cab of a work machine, such as a backhoe loader. The work machine includes a seat rotatable between front and rear positions. The control console includes a tower assembly that enables tiltable movement of the control consoles between stowed and operating positions and a controller connected with the tower assembly. When the seat is in the front position, an operator may operate specific functions for a loader bucket of the work machine. When the operator is ready to operate specific functions for a backhoe bucket of the work machine, the operator may rotate the seat from the front position to the rear position. However, the seat may remain in the front position to operate the specific function for the backhoe bucket. At that time, the operator may move the control console from the stowed position to the operating position through the movement of the tower assembly.

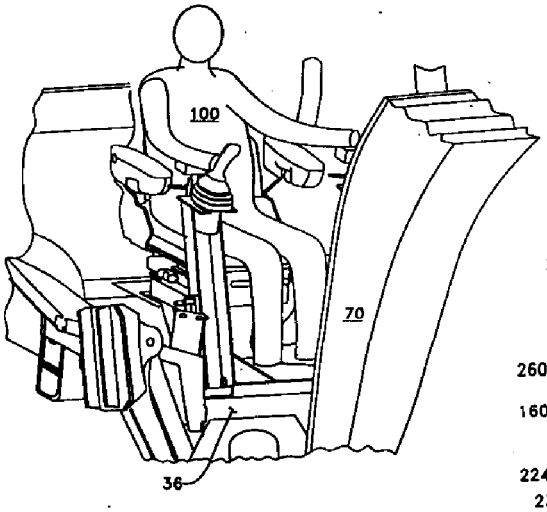

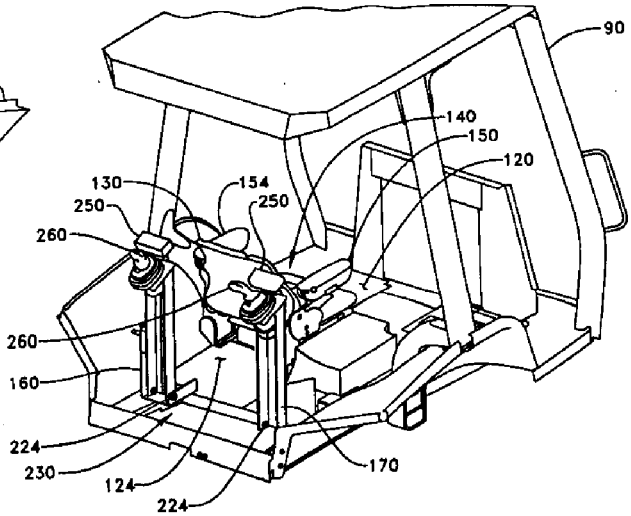

13 Claims, 11 Drawing Sheets